US005445126A

United States Patent [19]

Graves, Jr.

[11] Patent Number: 5,445,126

[45] Date of Patent: Aug. 29, 1995

[54] ACCELERATOR PEDAL CALIBRATION AND FAULT DETECTION

[75] Inventor: Roger A. Graves, Jr., Battle Creek, Mich.

[73] Assignee: Eaton Corporation, Cleveland, Ohio

[21] Appl. No.: 265,646

[22] Filed: Jun. 24, 1994

[51] Int. Cl.[6] ..... F02D 7/00

[52] U.S. Cl. ..... 123/399

[58] Field of Search ..... 123/399, 198 D; 364/424.1; 73/118.1, 1 D

[56] References Cited

U.S. PATENT DOCUMENTS

| | | | |
|---|---|---|---|
| 4,975,844 | 12/1990 | Holbrook et al. | 364/424.1 |
| 5,031,595 | 7/1991 | Heck et al. | 123/339 |
| 5,133,321 | 7/1992 | Hering et al. | 123/399 |
| 5,157,956 | 10/1992 | Isaji et al. | 73/1 D |
| 5,255,653 | 10/1993 | Ironside et al. | 123/399 |
| 5,320,076 | 6/1994 | Reppich et al. | 123/399 |
| 5,381,769 | 1/1995 | Nishigaki et al. | 123/399 |
| 5,396,869 | 3/1995 | Suzuki et al. | 123/399 |
| 5,415,144 | 5/1995 | Hardin et al. | 123/399 |

*Primary Examiner*—Raymond A. Nelli
*Attorney, Agent, or Firm*—Brooks & Kushman

[57] ABSTRACT

A system and method for automatically calibrating an electronic accelerator pedal having an idle validation switch is disclosed. Automatic calibration accommodates variation between vehicles so that error tolerances may be reduced. The system and method utilize the idle validation switch in combination with the accelerator pedal to provide redundancy by cross-checking signals received from each component. Automatic calibration is performed throughout operation of the vehicle. An initial idle position and an initial full throttle setting are chosen to induce a vehicle operator to fully depress the accelerator pedal. The fully depressed pedal determines the new full throttle position. Thereafter, under proper conditions, a new full throttle position (and analogously a new idle position) is set when a pedal sensor indicates the current position exceeds the current full throttle set point (or is less than the current idle set point). The system and method also provide a fail-safe design which returns to idle fueling when certain fault conditions are detected.

20 Claims, 4 Drawing Sheets

10
ECU
12
μP
14
ROM
16
RAM
18
INTERFACE
20
22
24
26
28
30
32
32a
A
B
C
D

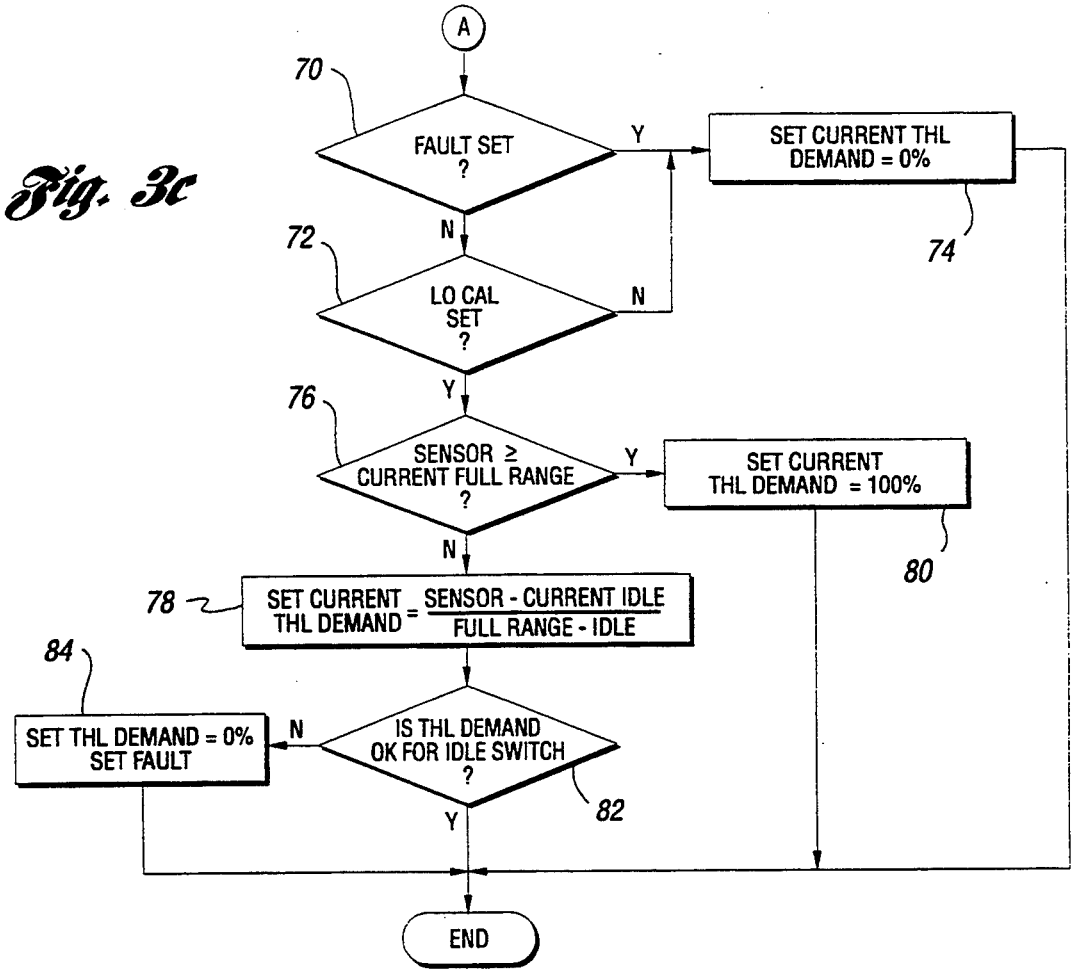
Fig. 3c
Fig. 3b
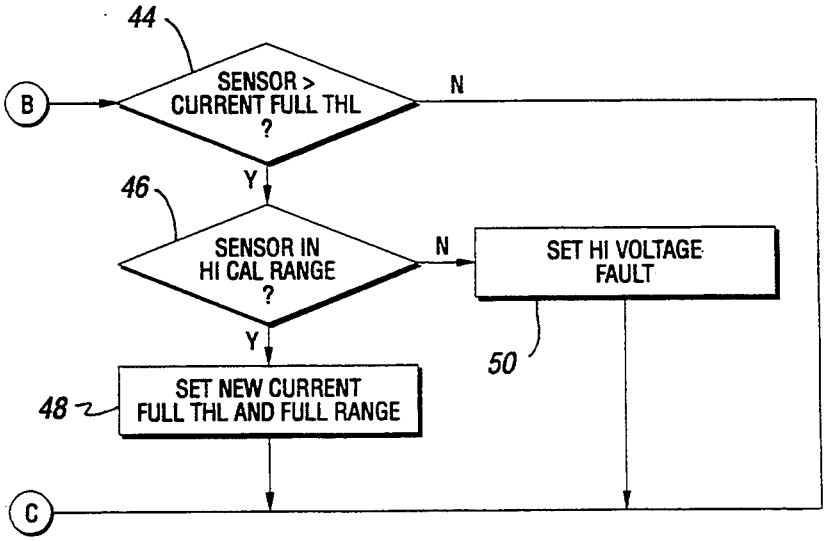

ACCELERATOR PEDAL CALIBRATION AND FAULT DETECTION

TECHNICAL FIELD

The present invention relates to a system and method for automatic calibration and fault detection for use with an electronic accelerator pedal.

BACKGROUND ART

A traditional accelerator pedal provides a mechanical linkage between a vehicle operator and a throttle valve located on the engine of a vehicle. By depressing the accelerator pedal, the throttle valve opens to allow more air into the engine while an additional quantity of fuel is also delivered to the engine. The resulting increase of fuel combustion thereby accelerates the vehicle. This type of engine fuel control is relatively low-cost, and has experienced reliable and dependable performance for a number of years.

A number of industries have been revolutionized by the age of electronics and the advent of the microprocessor, including the automotive industry. This has resulted in an ever-increasing ability to more precisely control processes and machines, especially motor vehicles. Prompted by consumer demand and government regulations, vehicle system manufacturers and suppliers are now utilizing electronics and microprocessors to perform an increasing number of tasks which were traditionally performed by mechanical apparatus. One such task is that of vehicle fuel control.

Electronic fuel control allows a microprocessor to manage the combustion process and adapt combustion to meet changing operating demands characterized by various operating modes, such as high performance, low emissions, optimal fuel economy, or constant speed control, to name a few. Early electronic fuel control systems relied upon a mechanical throttle linkage while incorporating electronic fuel injectors and electronic spark control. This was, perhaps, due to the established reliability and durability of a mechanical system compared to the relatively new electronic components. However, this type of hybrid system compromises performance features which are available to fully electronic systems. Thus, it is desirable to have a fully electronic fuel control system including an electronic accelerator pedal.

Obviously, fuel control is a very important function in the proper operation of a motor vehicle. Thus, the utilization of an electronic accelerator pedal necessitates a robust control system which is capable of fault detection and correction. Furthermore, it is desirable for the design to be fail-safe such that an unexpected component failure results in a default mode of operation or an orderly shut-down of the system.

Redundant components may be utilized where necessary to verify the proper operation of critical components or sensors. Since a throttle position sensor is one such critical component, it is desirable to provide some degree of redundancy in systems utilizing an electronic accelerator pedal.

In such systems which employ redundancy, a component fault is indicated by detecting a discrepancy between signals provided by the redundant components. It is therefore desirable to monitor signals from redundant components so as to detect any discrepancy between such signals which indicates a component fault.

A fail-safe design which incorporates redundant components is provided by an electronic accelerator pedal with an idle validation switch when used with the appropriate control algorithms. The proper functioning of a standard electronic accelerator position sensor (APS), such as one which conforms to the specifications generated by the Society of Automotive Engineers (SAE) in SAE J1843, is confirmed by an idle validation switch.

The idle validation switch is energized when the accelerator pedal is near its idle position. The idle position corresponds to the accelerator pedal being fully released. The idle validation switch, however, allows for some variation of the fully released position since it is typically energized when the accelerator pedal is depressed less than 10% of its full travel. The switch may include some hysteresis circuitry for debouncing, or this function may be performed by the vehicle controller. Since an electronic accelerator pedal is not mechanically linked to the throttle valve of the engine, the pedal position does not change with variations in engine idle speed, such as when the engine is cold compared to when the engine is hot.

The APS includes a potentiometer which is characterized by a variable electrical resistance depending upon the position of the accelerator pedal. By applying a known reference voltage across this variable resistance, a variable voltage signal is generated indicative of the accelerator pedal position. This variable voltage signal is one of the many inputs utilized by the vehicle controller to control the amount of fuel delivered to the engine. As is well known, other inputs affecting fuel control include coolant temperature, air temperature, and engine speed, among others.

Typically, the variable voltage signal is converted by the vehicle controller to a percentage of full throttle so that 0% corresponds to idle speed and 100% corresponds to full throttle. This percentage value is one parameter used to reference look-up tables which contain values representing the amount of fuel to deliver to the engine. Therefore, for consistent performance among vehicles, it is desirable to have consistent voltage values delivered by each APS.

As previously noted, the SAE has attempted to standardize the performance specifications of electronic accelerator pedals. However, the SAE J1843 specification still allows for significant variation in the acceptable ranges for an APS with an idle validation switch. Thus, a common practice in the automotive industry is to provide fault detection based on the maximum specification tolerances. This practice typically allows an error of between 5% and 15% before the controller considers a fault to exist. Due to the critical nature of fuel control, it is desirable to provide a method and system for automatically calibrating an APS equipped with an idle validation switch which conforms to that specification so as to reduce the error tolerance before a fault is indicated.

DISCLOSURE OF THE INVENTION

It is, therefore, an object of the present invention to provide a system and method for automatically calibrating an electronic accelerator pedal.

Another object of the present invention is to provide a fail-safe system and method for use with an electronic accelerator pedal such that an unexpected component failure will result in a default fault tolerant mode of operation or an orderly shut-down of the system.

An additional object of the present invention is to provide a system and method which utilize redundancy to detect a fault in an electronic accelerator pedal or idle validation switch.

A further object of the present invention is to provide a system and method for monitoring signals from an electronic accelerator pedal and idle validation switch so as to detect any discrepancy between such signals to indicate a system fault.

Yet another object of the present invention is to provide a system and method which reduces the system sensitivity to voltage signal variation among electronic accelerator pedals and idle validation switches.

Still another object of the present invention is to provide a system and method for automatically calibrating an electronic accelerator pedal and idle validation switch so as to reduce the error tolerance of the system.

Another object of the present invention is to provide a system and method having varying levels of fault detection depending on the level of calibration achieved for automatically calibrating an electronic accelerator pedal and idle validation switch.

In carrying out the above object and other objects and features of the present invention, a method for automatically calibrating an electronic accelerator pedal is provided. The method includes associating an idle parameter with a value representing the signal provided by the electronic accelerator pedal when power is first applied to the system and the signal is within a first calibration range. Next the engine fueling progression is altered to decrease the fueling response to the accelerator pedal so as to induce displacement of the accelerator to its fully depressed position. Finally, a full throttle parameter is associated with a value representing the signal provided by the electronic accelerator pedal when the signal is within a second calibration range so as to calibrate the electronic accelerator pedal.

The above objects and other objects, features, and advantages of the present invention will be readily appreciated by one of ordinary skill in the art from the following detailed description of the best mode for carrying out the invention when taken in connection with the accompanying drawings.

BEST MODE(S) FOR CARRYING OUT THE INVENTION

Figure 1:
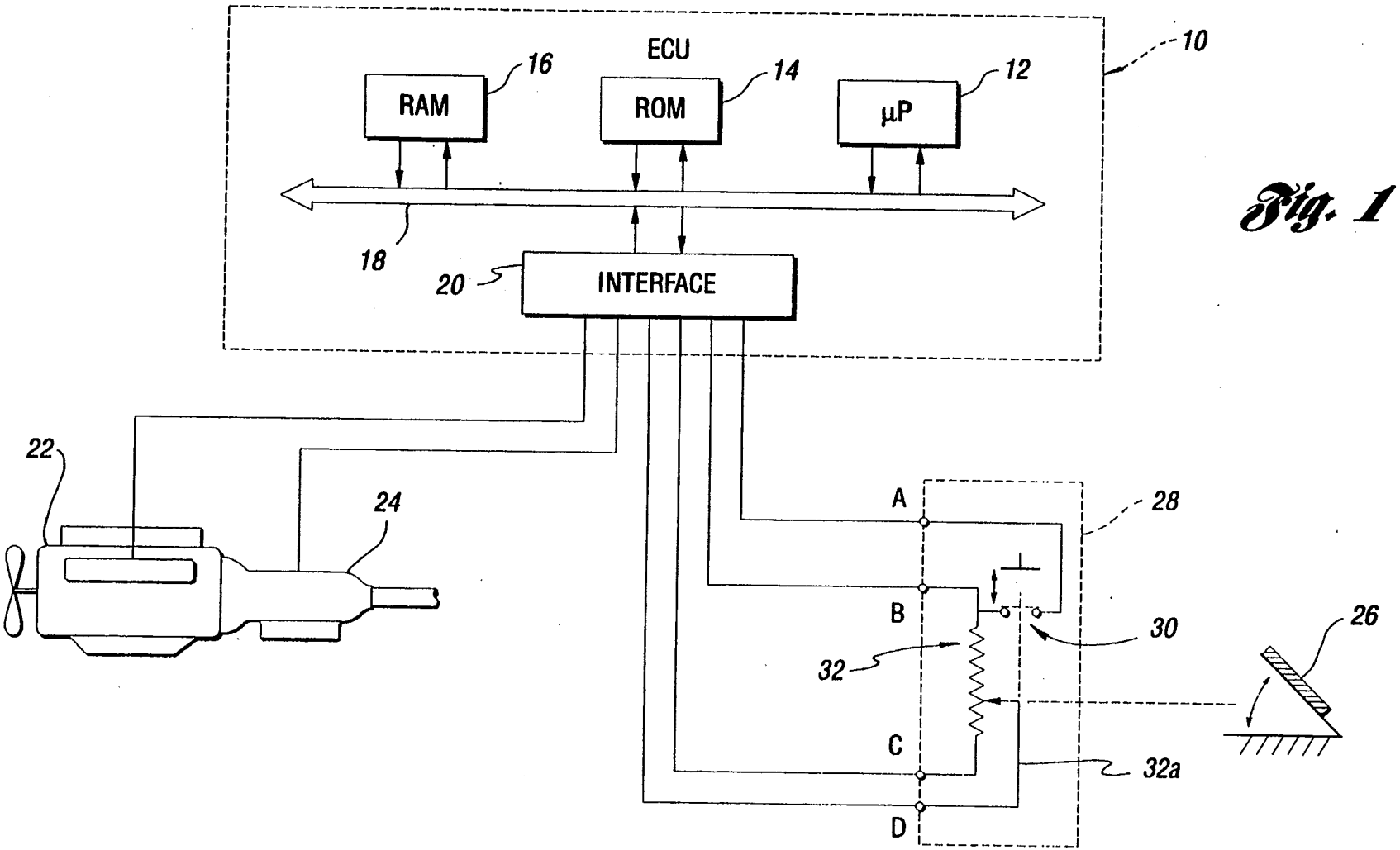
FIG. 1 is a block diagram of the control system according to the present invention.

Referring now to FIG. 1, a simplified block diagram of the control system for automatic calibration of an APS according to the present invention is shown. Preferably, the system is incorporated within a total vehicular control system to be used with tractor semi-trailer vehicles, such as Class 7 or Class 8 trucks which typically utilize throttle controlled diesel engines. Of course the system and method of the present invention could be utilized in other types of vehicles, or in other control systems which control fuel delivery to a throttle controlled engine.

The system illustrated in FIG. 1 includes an electronic control unit (ECU) 10 to effect control of the system. ECU 10 includes a microprocessor ($\mu$P) 12 for executing a predetermined set of instructions stored in a nonvolatile memory 12, such as a read-only memory (ROM). A volatile memory 14, such as a random-access memory (RAM) is used for storing temporary variables. Of course, ECU 10 may include other memories as well. Microprocessor 12 communicates with internal ECU components via a data bus 18. An interface 20, also in communication with data bus 18, allows two-way communication between ECU 10 and various well known input sensors and output actuators, not shown for the sake of clarity. Typically, ECU 10 communicates with an engine 22 and a transmission 24 to coordinate control of various functions such as fuel delivery, throttle opening, gear ratio selection, and the like. Electronic control units, such as ECU 10, are well known in the art and may be appreciated in greater detail by reference to U.S. Pat. No. 4,595,986, assigned to the assignee of the present invention, the specification of which is hereby incorporated by reference in its entirety.

With continuing reference to FIG. 1, an electronic accelerator pedal 26, for providing a signal indicative of a requested fueling level for the engine, is one of the sensors in communication with ECU 10 via interface 20. Electronic accelerator pedal 26 cooperates with an accelerator position sensor (APS) 28 which provides electrical signals to ECU 10 indicative of the current accelerator position. The APS may be integrated with accelerator pedal 26, or may be a separate component. The APS 28 typically includes an integrated, normally-open idle validation switch 30 and a potentiometer 32. A wiper 32*a* of potentiometer 32 is mechanically coupled to electronic accelerator pedal 26. Wiper 32*a* is also in .electrical communication with ECU 10.

In operation, ECU 10 provides a voltage across terminals B and C of potentiometer 32. When electronic accelerator pedal 26 is near its fully released position (i.e. the idle position), wiper arm 32*a* creates a voltage divider such that the voltage applied to terminals B and C is divided and only a portion of that voltage is present across terminals C and D. Preferably, a nominal voltage of 5 V is applied across terminals B and C. Idle validation switch 30 is closed such that substantially zero voltage appears across terminals A and B. As electronic accelerator pedal 26 is depressed, wiper arm 32*a* moves toward terminal B so as to increase the voltage across terminals C and D. At a predetermined point, idle validation switch 30 opens, creating an open circuit across terminals A and B. Preferably, idle validation switch 30 opens when electronic accelerator pedal 26 is depressed between 3% and 10% of its total allowable travel.

As accelerator pedal 26 is further depressed, the voltage across terminals C and D increases and approaches the value of voltage applied across terminals B and C. The analog voltage signal is converted to a digital value by interface 20, which may include various A/D converters, D/A converters, signal conditioners, and the like. ECU 10 may utilize the information derived from APS 28 to determine the throttle progression for controlling engine 22 and/or transmission 24, depending on the particular mode of operation. As is known by one of ordinary skill in the art, the SAE J1939 protocol specifies various operating modes for fuel control. The present invention is compatible with, yet independent of, the SAE J1939 protocol. If utilized with the SAE J1939 protocol, the throttle progression set by the present invention controls fueling while in a throttle tracking mode. During other operating modes, such as torque control, speed control, and torque and speed limiting, engine fueling may be independent of the accelerator pedal position. The throttle progression determines the amount of fuel delivered to engine 22 based on the position of accelerator pedal 26, i.e. the engine fueling response to the range of travel of the accelerator pedal.

Figure 2:
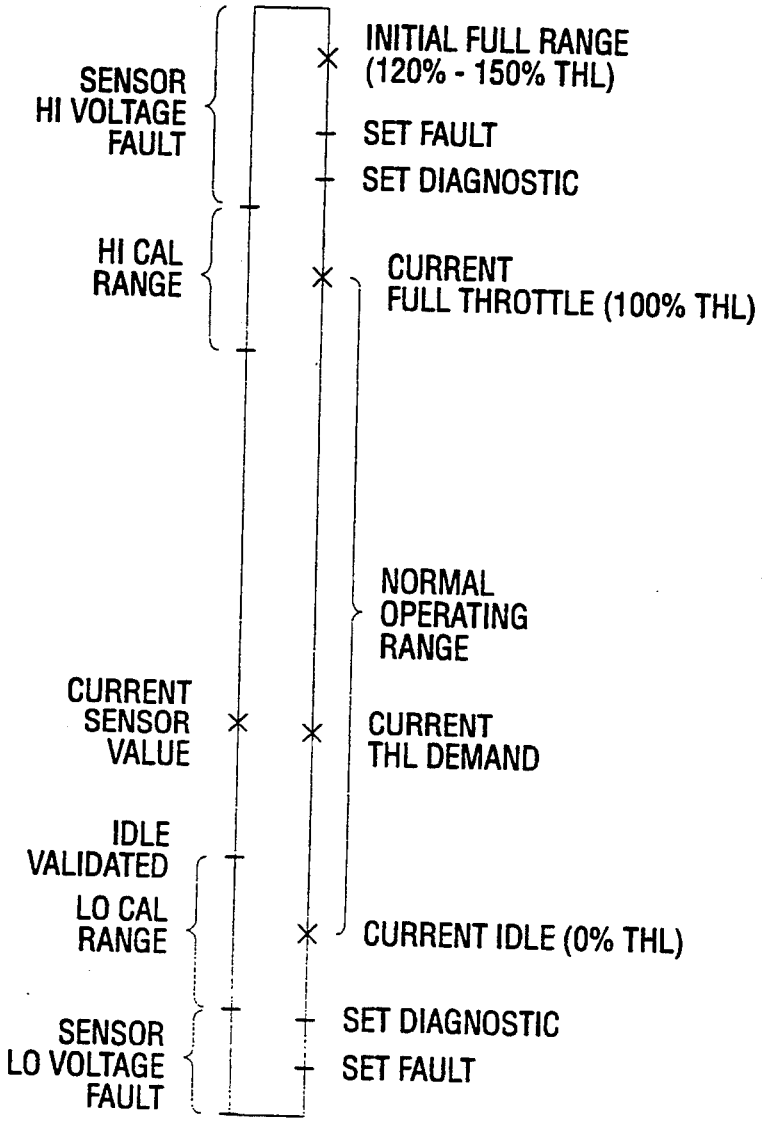
FIG. 2 is a diagram illustrating the relative values of various system parameters according to the present invention; and FIGS. *3a–3c* are flow charts illustrating the method for automatically calibrating an APS according to the present invention.

Referring now to FIG. 2, a diagram is shown which illustrates various parameter values utilized by the system and method of the present invention. Variables and parameters which have somewhat dynamic values and which change during operation of the system are indicated by an "x" on the scale. Other parameters are predetermined and remain fixed during normal operation of the system. Typical operating ranges are indicated with braces.

The following description of the system operation describes the role of each parameter, variable, and range illustrated in FIG. 2. An Initial Full Range value between 120% and 150% of the Normal Operating Range is set when the vehicle is started. The Current Full Throttle parameter is set to the Initial Full Range value. This alters the normal fueling progression by reducing the fueling response to a particular range of travel of accelerator pedal 26 (represented by Current THL Demand) as explained in greater detail below. This induces the operator to fully depress the accelerator pedal to a positive stop corresponding to full throttle. Once the accelerator pedal has been fully depressed, and the sensor signal is within the Hi Cal calibration range, a new value for Current Full Throttle (100% THL) is set, as described below.

After Current Full Throttle has been set, any voltage reading produced by the APS which is within the Hi Cal Range, but which exceeds the Current Full Throttle, results in a new Current Full Throttle setting. If the voltage value exceeds the Set Diagnostic parameter, a diagnostic code may be stored in the ECU but system operation is unaffected. If the voltage value exceeds the Set Fault parameter, a fault is stored and a fault handling sequence is initiated. The fault handling sequence may default to an engine fueling level corresponding to normal engine idle speed, or perform other such appropriate actions.

Still referring to FIG. 2, as the accelerator pedal is released, Current THL Demand will decrease until the idle validation switch is energized which corresponds to the Idle Validated parameter. The Current Idle (0% THL) is set when Current THL Demand is within the Lo Cal Range and the Idle Validated parameter is set. Thereafter, Current Idle is reset whenever Current THL Demand is below Current Idle but still within the Lo Cal Range. If the APS provides a voltage which is within the Sensor Lo Voltage Fault range, a diagnostic or fault may be set depending upon whether the Set Diagnostic or the Set Fault parameters have been traversed. As before, a diagnostic does not affect system operation whereas a fault results in corrective action being taken.

Figure 3A:
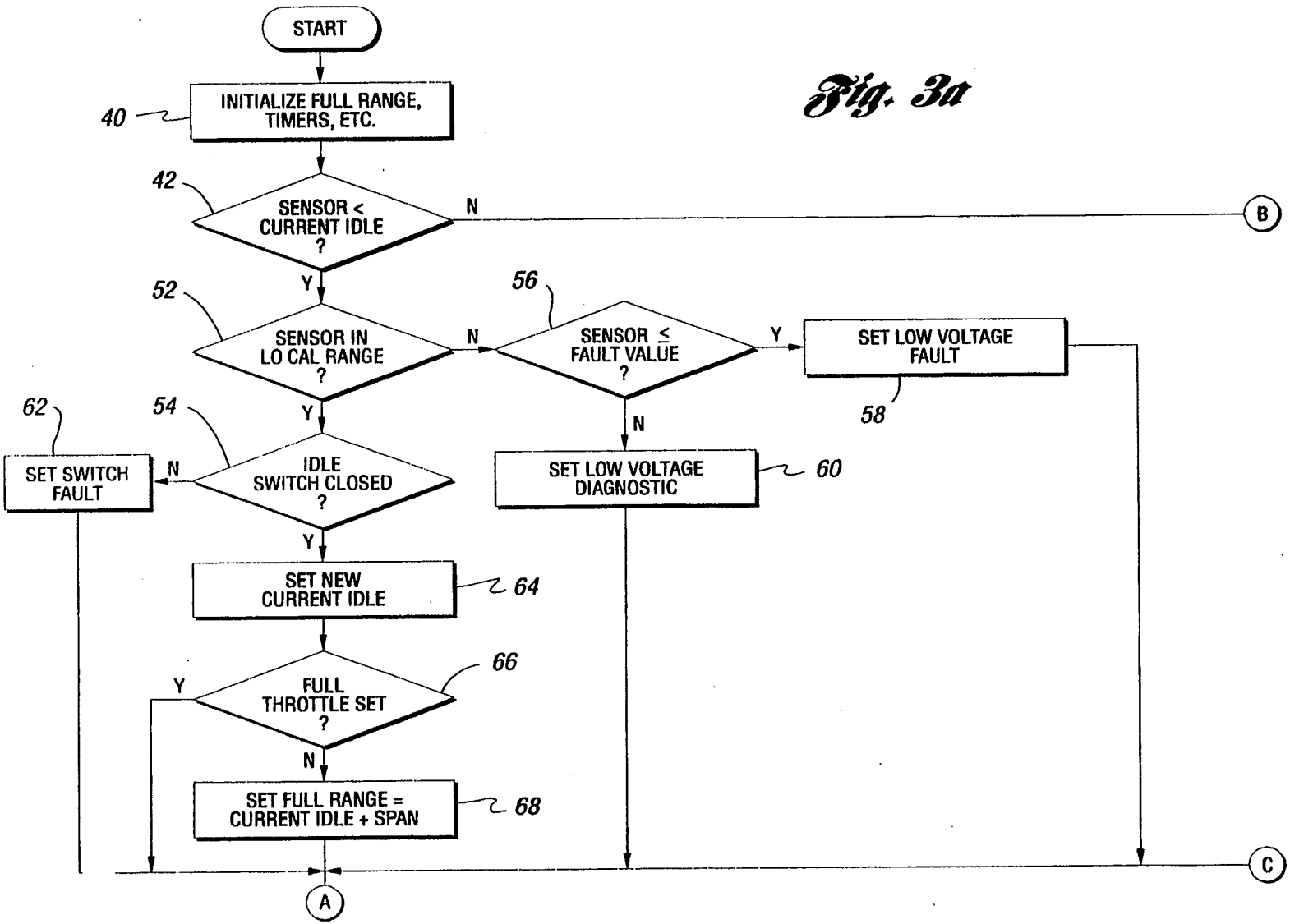

Referring now to FIG. 3*a*, a flow chart illustrating the method of automatically calibrating an APS according to the present invention is shown. At step 40, system variables are initialized. This includes resetting appropriate timers and counters, as well as setting the Initial Full Range value as described above. At step 42, a test is performed to determine if the current APS voltage value is below the Current Idle parameter. If the result of step 42 is true, processing continues with step 52. Otherwise processing continues with step 44 of FIG. 3*b*.

With reference now to FIG. 3*b*, at step 44, a test is performed to determine if the value of the APS voltage is greater than the Current Full Throttle (THL) value. If the result of the test is true, processing continues with step 46. Otherwise, processing continues with step 70 (FIG. 3*c*). At step 46, a test is performed to determine if the current APS voltage value is within the Hi Cal Range. If the result of the test is true, a new Current Full THL value and Full Range value are set corresponding to the APS voltage value at step 48, and processing continues with step 70 of FIG. 3*c*. Otherwise, a fault is set at step 50 (which may be used for diagnostics or to initiate an alternative control sequence) and processing continues with step 70 of FIG. 3*c*.

Returning now to FIG. 3*a*, step 52 determines if the value of APS voltage is within the Lo Cal Range. If the value is within that range, processing continues with step 54. Otherwise, processing branches to step 56 which determines if the value of the APS voltage is below the Set Fault value. If that test result is true, a Lo Voltage fault is set at step 58. Otherwise, a Lo Voltage Diagnostic is set at step 60. Processing continues with step 70 (FIG. 3*c*) after either step 58 or step 60 have been completed.

As also illustrated in FIG. 3*a*, if APS voltage is within the Lo Cal Range, the state of idle validation switch 30 is checked at step 54. If idle validation switch 30 is closed, a new Current Idle position is set at step 64. Otherwise, an idle validation switch fault is set at step 62 and processing continues at step 70 (FIG. 3*b*). Step 66 determines whether Full Throttle (and therefore Full Range) has already been set at step 50. Step 68 is not executed if those parameters have already been set. If Full Throttle has not been set (i.e. the accelerator pedal has not yet been fully depressed), step 68 establishes an approximate Full Range value by adding the maximum span (as determined by the SAE J1843 specification) to the Current Idle value.

Step 70 of FIG. 3*c* determines whether a fault has been set and directs processing accordingly. If a fault has been indicated, the Current THL Demand is set to 0% at step 74. Similarly, if a Lo Ca/has not yet been performed (step 72 of FIG. 3*c*) and the idle validation switch is energized, then the Current THL Demand is also set to 0% at step 74. Otherwise, step 76 determines if the APS voltage value exceeds the Current Full Range. If the result of the test is true, Current THL Demand is set to 100% at step 80. Otherwise, Current THL Demand is set to a percentage of the full travel value at step 78. Step 82 performs a cross-check between the idle validation switch and the APS by determining if the Current THL Demand is appropriate for the state of the idle validation switch. If the state of the idle validation switch disagrees with the calculated Current THL Demand, step 84 sets a fault and sets the Current THL Demand to 0% which corresponds to an idle fueling level.

The flowchart illustrating the method of the present invention in FIGS. 3*a*–3*c* depicts sequential processing for ease of illustration and description. Of course, alternative processing strategies, such as interrupt driven processing, may be used to implement the system and method of the present invention, as is well known in the art. Thus, the order of many of the detailed steps described above may be interchanged without affecting the final result.

It is understood, of course, that while the form of the invention herein shown and described includes the best mode for carrying out the invention, it is not intended to illustrate all possible forms thereof. It will also be understood that the words used are descriptive rather than limiting, and that various changes may be made without departing from the spirit and scope of the invention disclosed.

What is claimed is:

1. A calibration for use with a vehicle equipped with said throttle controlled engine and an electronic control unit having a processor for executing a predetermined set of instructions stored in a memory so as to control the engine, the vehicle also including in electronic accelerator pedal in communication with the processor for providing a signal indicative of a requested fueling level for the engine, the accelerator pedal having a range of travel between a fully released position and a fully depressed position, a method for automatically calibrating the electronic accelerator pedal comprising:

associating a first parameter stored in the memory with a value representing the signal provided by the electronic accelerator pedal when power is first applied to the system and the signal is within a first predetermined calibration range;

altering engine fueling progression to provide a decreased engine fueling response to the range of travel of the electronic accelerator pedal so as to induce displacement of the electronic accelerator pedal to the fully depressed position; and associating a second parameter stored in the memory with a value representing the signal provided by the electronic accelerator pedal when the signal is within a second predetermined calibration range so as to automatically calibrate the electronic accelerator pedal.

2. The method of claim 1 further comprising storing a new value in the memory for the first parameter representing the signal provided by the electronic accelerator pedal when the signal value is within the first predetermined calibration range and the signal value is less than the previously stored value for the first parameter.

3. The method of claim 1 further comprising storing a new value in the memory for the second parameter representing the signal provided by the electronic accelerator pedal when the signal value is within the second predetermined calibration range and the signal value exceeds the previously stored value for the second parameter.

4. The method of claim 1 further comprising initiating a fault handling sequence when the signal provided by the electronic accelerator pedal has a value which exceeds the highest value of the second predetermined range, the sequence including effecting an idle engine fueling level and storing a fault in the memory.

5. The method of claim 1 further comprising initiating a fault handling sequence when the signal provided by the electronic accelerator pedal has a value which is less than the lowest value of the first predetermined calibration range, the sequence including effecting an idle engine fueling level and storing a fault in the memory.

6. The method of claim 1 wherein the vehicle further includes an idle validation switch which cooperates with the electronic accelerator pedal for providing an additional signal used by the electronic control unit to validate the signal provided by the electronic accelerator pedal, and wherein the step of associating a first parameter is performed only if both the additional signal and the signal provided by the electronic accelerator pedal indicate an electronic accelerator pedal position within the range of travel.

7. The method of claim 1 wherein altering engine fueling progression comprises storing a value for the second parameter which exceeds a normal operating value by a predetermined multiplication factor.

8. The method of claim 7 wherein the predetermined multiplication factor is within the range of about 1.2 to 1.5.

9. An electronic accelerator pedal calibration system in a vehicle comprising a throttle controlled engine and an electronic control unit having a processor for executing a predetermined set of instructions stored in a memory so as to control the engine, the vehicle also including an electronic accelerator pedal in communication with the processor for providing a signal indicative of a requested fueling level for the engine, the accelerator pedal having a range of travel between a fully, released position and a fully depressed position, said system for automatically calibrating the electronic accelerator pedal including:

means microprocessor for associating a first parameter stored in the memory with a value representing the signal provided by the electronic accelerator pedal when power is first applied to the vehicle and the signal value is within a first predetermined calibration range;

said microprocessor means further programmed to alter engine fueling progression to provide a decreased engine fueling response to the range of travel of the electronic accelerator pedal so as to induce displacement of the electronic accelerator pedal to the fully depressed position; and said microprocess means further associating a second parameter stored in the memory with a value representing the signal provided by the electronic accelerator pedal when the signal value is within a second predetermined calibration range so as to automatically calibrate the electronic accelerator pedal.

10. The system of claim 9 wherein said microprocessor further stores a new value in the memory for the first parameter representing the signal provided by the electronic accelerator pedal when the signal value is within the first predetermined calibration range and the signal value is less than the previously stored value for the first parameter.

11. The system of claim 9 wherein said microprocessor means stores a new value in the memory for the second parameter representing the signal provided by the electronic accelerator pedal when the signal value is within the second predetermined calibration range and the signal value exceeds the previously stored value for the second parameter.

12. The system of claim 9 wherein said microprocessor means further means for initiating a fault handling sequence when the signal value of the signal provided by the electronic accelerator pedal exceeds the highest value of the second predetermined range, the sequence including effecting an idle engine fueling level and storing a fault in the memory.

13. The system of claim 9 further comprising initiates a fault handling sequence when the signal value of the signal provided by the electronic accelerator pedal is less than the lowest value of the first predetermined calibration range, the sequence including effecting an idle engine fueling level and storing a fault in the memory.

14. The system of claim 9 wherein the vehicle further includes an idle validation switch in cooperation with the electronic accelerator pedal for providing an additional signal used by the electronic control unit to validate the signal provided by the electronic accelerator pedal, and wherein said microprocessor means for associating a first parameter associates said first parameter only if both the additional signal and the signal provided by the electronic accelerator pedal indicate an electronic accelerator pedal position within the range of travel.

15. The system of claim 9 wherein said microprocessor means for altering engine fueling progression stores a value for the second parameter which exceeds a normal operating value by a predetermined multiplication factor.

16. The system of claim 15 wherein the predetermined multiplication factor is within the range of about 1.2 to 1.5.

17. An electronic accelerator pedal calibration system in a vehicle comprising a throttle controlled engine and an electronic accelerator pedal for providing a signal indicative of a requested fueling level for the engine, the accelerator pedal having a range of travel between a fully released position and a fully depressed position, said system for automatically calibrating the electronic accelerator pedal including:

a microprocessor in communication with the engine and the electronic accelerator pedal, the said microprocessor being operative to execute a predetermined set of instructions stored in a memory so as to control the engine, the electronic control unit also being operative to associate a first parameter stored in the memory with a value representing the signal provided by the electronic accelerator pedal when power is first applied to the system and the signal value is within a first predetermined calibration range, to alter engine fueling progression to provide a decreased engine fueling response to the range of travel of the electronic accelerator pedal so as to induce displacement of the electronic accelerator pedal to the fully depressed position, and to associate a second parameter stored in the memory with a value representing the signal provided by the electronic accelerator pedal when the signal value is within a second predetermined calibration range so as to automatically calibrate the electronic accelerator pedal.

18. The system of claim 17 wherein the electronic control unit is also operative to store a new value in the memory for the first parameter which represents the signal provided by the electronic accelerator pedal when the signal value is within the first predetermined calibration range and is less than the previously stored value for the first parameter.

19. The system of claim 17 wherein said microprocessor is further operative to store a new value in the memory for the second parameter which represents the signal provided by the electronic accelerator pedal when the signal value is within the second predetermined calibration range and exceeds the previously stored value for the second parameter.

20. The system of claim 17 wherein the vehicle further includes an idle validation switch in cooperation with the electronic accelerator pedal for providing an additional signal used by said microprocessor to validate the signal provided by the electronic accelerator pedal, and wherein said microprocessor associates a first parameter with a value only if both the additional signal and the signal provided by the electronic accelerator pedal indicate an electronic accelerator pedal position within the range of travel.

* * * * *

UNITED STATES PATENT AND TRADEMARK OFFICE

CERTIFICATE OF CORRECTION

PATENT NO. : 5,445,126

DATED : August 29, 1995

INVENTOR(S) : ROGER A. GRAVES, JR.

It is certified that error appears in the above-identified patent and that said Letters Patent is hereby corrected as shown below:

| | |
|---|---|
| Column 6, line 44, | After "Lo" replace "Ca/has" with --Cal has--. |
| Claim 1, column 7, line 10, | After "calibration" insert --method--. |
| Claim 10, column 8, line 43, | After "microprocessor" insert --means--. |
| Claim 11, column 8, line 50, | After "means" insert --further--. |
| Claim 12, column 8, line 57, | After "further" delete "means for initiating" and insert --initiates-- therefor. |
| Claim 13, column 8, line 64, | Insert --wherein said microprocessor means-- before "further"; delete "comprising". |
| Claim 17, column 9, line 31-2, | Delete "said microprocessor" and substitute therefor --electronic control unit--. |

UNITED STATES PATENT AND TRADEMARK OFFICE

CERTIFICATE OF CORRECTION

PATENT NO. : 5,445,126

DATED : August 29, 1995

INVENTOR(S) : ROGER A. GRAVES, JR.

It is certified that error appears in the above-identified patent and that said Letters Patent is hereby corrected as shown below:

| | |
|---|---|
| Claim 17, column 9, line 34, | Delete "the electronic control unit" and substitute --said microprocessor-- therefor. |

Signed and Sealed this

Twelfth Day of December, 1995

*Attest:*

*Attesting Officer*

Bruce Lehman

BRUCE LEHMAN

*Commissioner of Patents and Trademarks*